US005983609A

United States Patent [19]

van der Werff et al.

[11] Patent Number: 5,983,609

[45] Date of Patent: Nov. 16, 1999

[54] METHOD AND APPARATUS FOR OPENING AN ENVELOPE

[75] Inventors: Jeichienus Adriaan van der Werff, Montfoort; Willem Coenraad Bergwerf, Drachten, both of Netherlands

[73] Assignee: Hadewe B.V., Drachten, Netherlands

[21] Appl. No.: 08/532,935

[22] Filed: Sep. 22, 1995

[30] Foreign Application Priority Data

Sep. 23, 1994 [NL] Netherlands ..... 9401553

[51] Int. Cl.[6] ..... B65B 43/26

[52] U.S. Cl. ..... 53/492; 53/381.3

[58] Field of Search ..... 53/381.2, 381.3, 53/381.5, 492; 83/54, 444, 446, 449, 946, 676, 881, 430, 426; 408/77, 78

[56] References Cited

U.S. PATENT DOCUMENTS

| | | | |
|---|---|---|---|
| 2,412,047 | 12/1946 | Huck | 83/430 |
| 2,513,797 | 7/1950 | Hassan | 83/444 |
| 3,491,807 | 1/1970 | Underwood | 83/446 |
| 3,613,315 | 10/1971 | Schickling . | |
| 4,319,444 | 3/1982 | Russell . | |
| 4,843,801 | 7/1989 | Roncero | 53/382.1 |
| 4,926,729 | 5/1990 | Igarashi | 53/381.3 |
| 5,152,206 | 10/1992 | Mulling | 83/444 |
| 5,188,504 | 2/1993 | Nelson . | |
| 5,404,782 | 4/1995 | Ryan et al. | 83/444 |
| 5,475,967 | 12/1995 | Levi | 53/492 |

FOREIGN PATENT DOCUMENTS

| | | |
|---|---|---|
| 2 135 481 | 12/1972 | France . |
| 2 453 735 | 11/1980 | France . |
| 693322 | 6/1940 | Germany . |
| 26 32 425 | 2/1977 | Germany . |
| 254264 | 12/1948 | Switzerland . |
| 648 794 | 4/1985 | Switzerland . |
| 625 469 | 6/1949 | United Kingdom . |

*Primary Examiner*—Jessica J. Harrison
*Assistant Examiner*—John Paradiso
*Attorney, Agent, or Firm*—Burns, Doane, Swecker & Mathis, L.L.P.

[57] ABSTRACT

An envelope (23) to be opened is moved along a tangent line to a rotating circular cutting edge (2), with the cutting edge (2) making an incision in a wall of the envelope (23). The envelope (23) is moved at a predetermined speed of transport which is different from the speed of revolution of the cutting edge (2). The cutting edge (2) moves in longitudinal direction along the material to be incised, so that a better cutting action is obtained. Each part of the material to be incised comes into contact with a large part of the cutting edge (2). As a result, the cutting action and the depth of incision are little affected by unroundness and eccentricity of the cutting edge (2). The cutting edge (2) wears uniformly because parts of the cutting edge (2) wear faster according as they project further from the axis of rotation (3). Also disclosed is an apparatus for practising this method.

12 Claims, 2 Drawing Sheets

METHOD AND APPARATUS FOR OPENING AN ENVELOPE

FIELD AND BACKGROUND OF THE INVENTION

This invention relates to a method for opening an envelope, in which the envelope is displaced in a direction of transport along a circular cutting edge rotatable in a plane parallel to the direction of transport and the cutting edge makes at least one incision in at least one wall of the envelope.

Such a method is known from Swiss patent specification 648 794. In this known method, the envelopes are heated by means of a spiral filament in the area where the incision is to be made, in order to remove or weaken a coating, if any, on the paper to be cut, so that the incision can be made with greater reliability. This solutions however, complicates the construction of the envelope opener considerably because special materials are necessary to obtain the required heat resistance in the area of the spiral filament and to avoid the envelope opener reaching so high a temperature in a large area around the spiral filament as to give rise to the risk of burns. A further disadvantage of this solution is that in the case where an envelope gets stuck at the location of the spiral filament, there is a danger of the contents getting singed or burnt. Due to the possibility of the envelope catching fire, the apparatus moreover constitutes a substantial fire hazard.

SUMMARY OF THE INVENTION

The object of the invention is to provide an envelope opener with a rotary cutting edge, which affords better cutting properties as regards the reliability with which an incision is made and as regards the accuracy with which the depth of the incision can be controlled.

This object is achieved in accordance with the invention in that the displacement of the envelope is carried out at a predetermined speed of transport different from the circumferential speed of the cutting edge, in such a manner that the cutting edge, at the location where the incision is made, moves relative to a portion of the envelope being cut by the cutting edge.

Owing to the cutting edge moving in longitudinal direction relative to the material of the envelope to be incised, a better cutting action is obtained.

A further advantage of the movement of the cutting edge in longitudinal direction relative to the material to be incised is that each part of the material to be incised comes into contact with a relatively large portion of the cutting edge. As a result, the cutting action and the depth of incision are affected to a lesser extent by any unroundness, eccentricity or local damage of the cutting edge.

The cutting disc has a uniform wear characteristic because parts of the cutting edge wear faster according as they project further from the axis of rotation.

The invention can also be embodied in an envelope opener especially designed for practising the method according to the invention.

DETAILED DESCRIPTION

Figure 1:
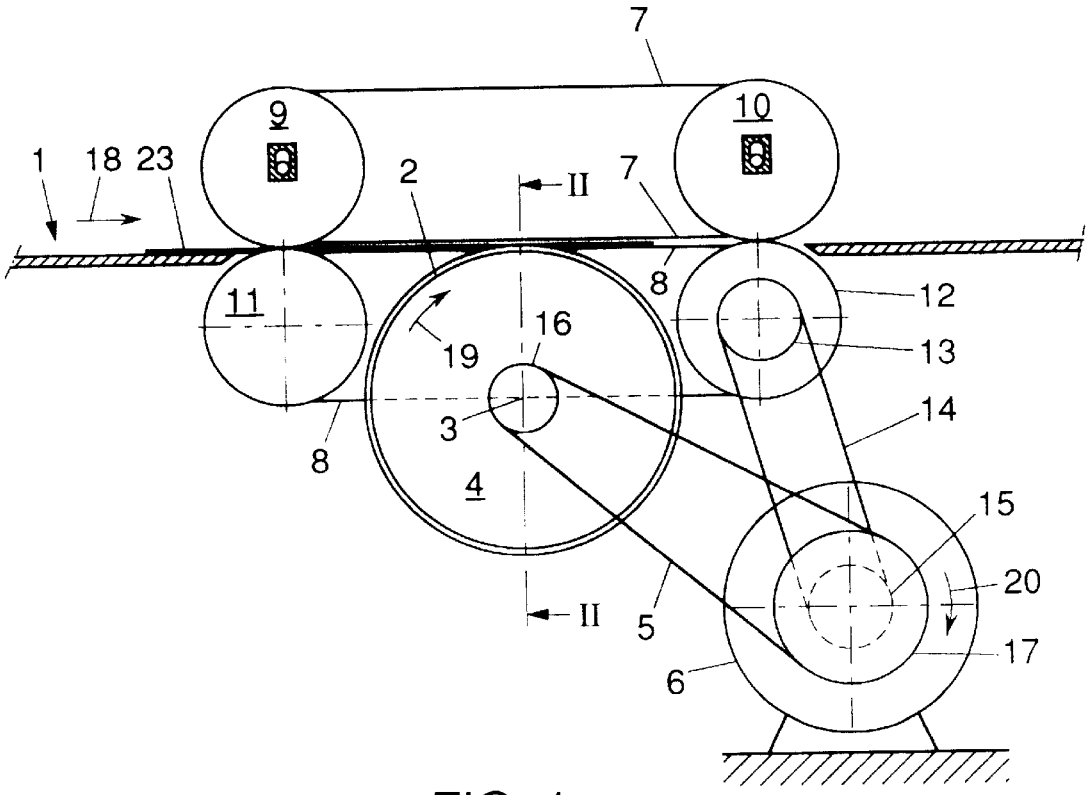
FIG. 1 is a diagrammatic cutaway side elevation of an envelope opener according to the invention.

Corresponding parts of the exemplary embodiments shown are designated in the drawings by the same reference numerals.

Figure 2:
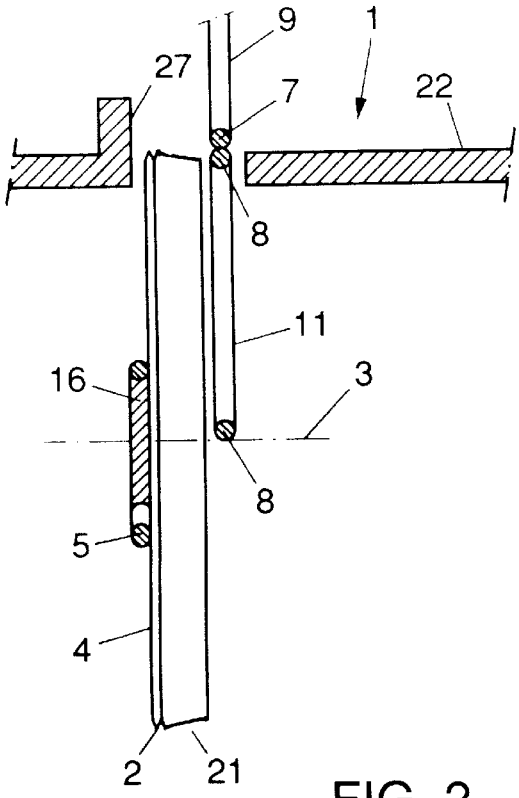
FIG. 2 is a sectional elevation taken on the line II—II in FIG. 1.

The apparatus for opening an envelope 23 as shown in FIGS. 1 and 2 comprises a transport track 1 for transporting an envelope 23 and a circular cutting edge 2 which is rotatable about an axis 3 directed transversely to the transport track 1. In the embodiment shown, the cutting edge 2 is designed as the outer circumference of a round cutting disc 4. A part of the cutting edge 2 directed substantially parallel to the transport track 1 projects into the transport track 1. The cutting disc 4 is driven through pulleys 16, 17 and a drive belt 5 by an output shaft of a motor 6 for rotating the cutting disc 4 at a particular speed of revolution. The pulley 16 is fixed to the cutting disc 4 and the pulley 17 is fixed to the output shaft of the motor 6. The direction of rotation of the motor is designated with an arrow 20.

The transport track 1 comprises upper and lower endless conveyor belts 7 and 8, respectively, which pass over return wheels 9, 10 and 11, 12, respectively, for maintaining in operation a predetermined speed of transport at which the envelopes are transported. One of the lower return wheels 12 is fixed to a rope pulley 13. The rope pulley 13 is driven via a drive belt 14 and a rope pulley 15, coupled to the motor 6. The transmission ratios between the motor 6 and the cutting disc 4 on the one hand and the motor 6 and the return wheels 9–11 on the other is chosen such that in operation the travelling speed of the conveyor belts 7, 8, and hence the speed of transport of the envelopes, is different from the speed of revolution of the cutting edge 2. The return pulleys 9, 10 of the upper conveyor belt 7 are suspended so as to be vertically movable, so that the distance between the conveyor belts 7, 8 can adjust to the thickness of the envelopes being Passed along the cutting edge 2.

In operation, the envelopes are moved in a direction designated with an arrow 18 along a tangent to the cutting edge 2. The cutting disk 4 rotates in a plane parallel to this tangent line and at a particular speed of revolution in a direction indicated by the arrow 19. The cutting edge 2 makes an incision in at least one wall of each envelope 23. The displacement of the envelopes is effected at a predetermined speed of transport which is different from the speed of revolution of the cutting edge 2.

Because the speed of the envelope 23 differs from the speed of revolution of the portion of the cutting edge 2 at the transport track 1, the cutting edge 2 during cutting moves in a longitudinal direction relative to the material of the envelope 23 being cut. As a result, a better cutting action is obtained.

During cutting, the envelope material adjoining the progressive incision comes into contact with a large portion of the passing cutting edge 2. Because a large part of the cutting edge passes every part of the envelope 23 at the cutting location at the transport track 1, a uniform cutting action and in particular a uniform incision depth are obtained in spite of any unroundness and eccentricity of the cutting edge 2.

Moreover, the cutting disc 2 is subject to uniform wear in circumferential direction because parts of the cutting edge 2 wear faster according as they project further from the axis of rotation 3.

The conveyor belts 7, 9 for controlling in operation the speed at which the envelope 23 is transported are coupled to the motor 6 in such a manner that the envelopes are transported in the same linear direction 18 as the direction (continuation of the direction indicated by the arrow 19) of the part of the cutting edge 2 projecting into the transport track, with the speed of transport of the envelopes being lower than the speed of revolution of the cutting edge 2.

At the location where the incision is made, the cutting edge 2 moves relative to the envelope 23 in the direction 18 in which the envelope 23 is being moved. As a result, the cutting portion of the cutting edge 2 continuously moves by a component towards the envelope 23, and the envelope 23 is prevented from being pulled towards the cutting edge 2 by the action of the cutting edge 2 and the incision from being deeper than contemplated. Because the envelope 23 moves relatively slowly in comparison with the cutting edge 2, every envelope portion to be cut is exposed to the cutting action of the cutting edge for a relatively long time, which promotes effective action of the cutting edge 2. Further, the frictional force exerted on the envelopes by the cutting edge 2 act in the direction of the transport of the envelopes and large differences in speed are feasible without the envelopes needing to be transported at a high speed.

The speed of the conveyor belts 7, 8 is preferably coupled to the speed of revolution of the cutting edge in such a manner that the speed of transport of the envelope 23 is at most two-thirds of the speed of revolution of the cutting edge. As a result, per unit length of incision to be made, a length of cutting edge 1.5 times as long as that unit length passes by, so that a proper cutting action is achieved.

In the envelope opener shown, the transmission ratios in the drive of the cutting disc 4 and of the conveyor belts 7, 8 are chosen such that the circumferential speed of the cutting edge 2 is approximately six times as high as the travelling speed of the conveyor belts 7, 8. Larger differences in speed are possible as well.

It is also possible that the means for controlling in operation the speed at which the envelope 23 is transported are designed for controlling the speed of transport in such a manner that the envelope 23 is transported in a direction opposite to the direction of movement of the part of the cutting edge projecting into the transport track. When the gutting edge, at the location where the incision is to be made, moves relative to the envelope 23 in a direction opposite to the direction in which the envelope 23 is being moved, then, per unit length of incision to be made, at a particular circumferential speed, a relatively large cutting edge portion passes the envelope 23.

Preferably, the incision is made exclusively in a wall of the envelope 23 proximal to the cutting edge 2. In the method according to the invention this is well possible because by virtue of the relative movement of the cutting edge 2 relative to the envelope material to be cut, a low pressure force of the envelope 23 against the cutting edge suffices to achieve an effective cutting action.

The cutting edge 2 is smooth in circumferential direction. This provides an advantage over, for instance, a knurled or toothed cutting edge in that little material is cut loose from the envelopes, so that little dust is produced.

Directly next to and coaxially with the cutting edge 2 extends a circular supporting surface 21. The distance by which the cutting edge 2 projects in radial direction relative to the supporting surface 21 defines the depth of the incision. This distance is easier to control than the distance by which the cutting edge 2 projects relative to a supporting surface 22 of the transport track 1. Thus an accurate control of the incision depth can be achieved without the necessity of accurate tolerances regarding the position of the cutting edge 2 relative to the supporting surface 22 of the transport track 1 or requiring that the position of the cutting disc 4 be vertically adjustable. If a different depth of incision is desired, the cutting disc 4 can simply be replaced by a cutting disc whose cutting edge 2 projects to a greater or lesser extent relative to the circular supporting surface 21.

The supporting surface 21 is non-rotatably coupled to the cutting edge 2, which renders the construction very simple and renders it easy to control the extent to which the cutting edge 2 projects relative to the circular supporting surface 21. In operation, the circular supporting surface 21 slides under the envelope 23. In order to limit the friction between the circular supporting surface 21 and the envelope 23, the circular supporting surface 21 may for instance be polished and/or chromed.

As appears from FIG. 2, the circular supporting surface 22 has a greater diameter on the side of the cutting edge 2 than on the side remote from the cutting edge 2. This provides the advantage that it is ensured that the envelope 23 is supported close to the cutting edge 2. This in turn renders the depth of incision properly controllable, regardless of whether the envelope 23 in the area of the incision to be made has a thickness that decreases to a greater or lesser extent towards the envelope edge.

Figure 3:
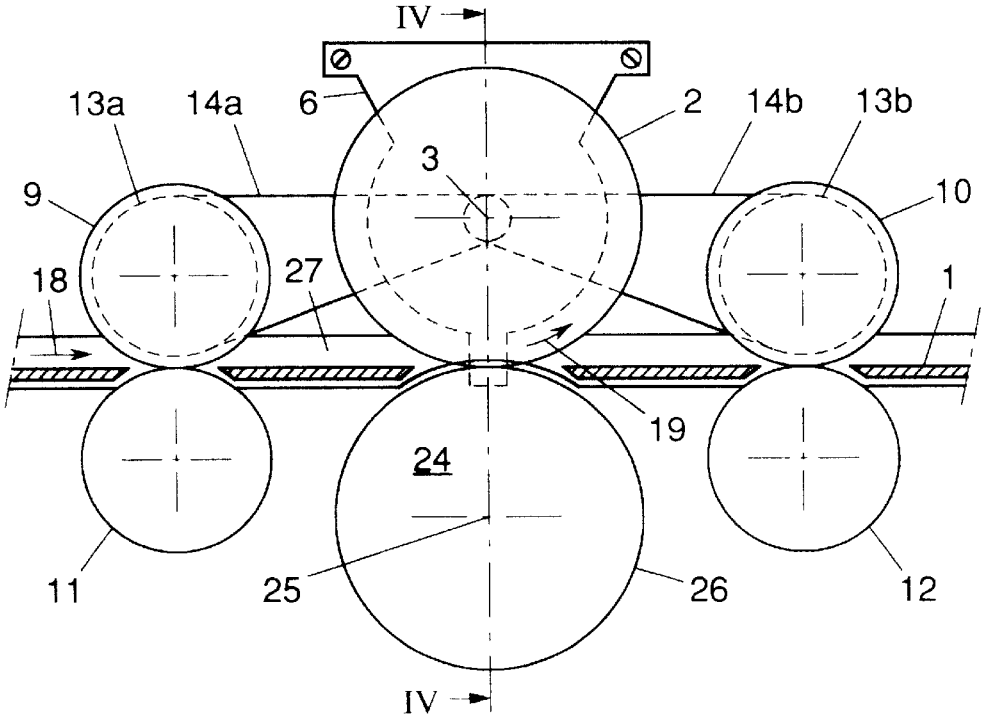
FIG. 3 is a diagrammatic cutaway side elevation of a second envelope opener according to the invention.
Figure 4:
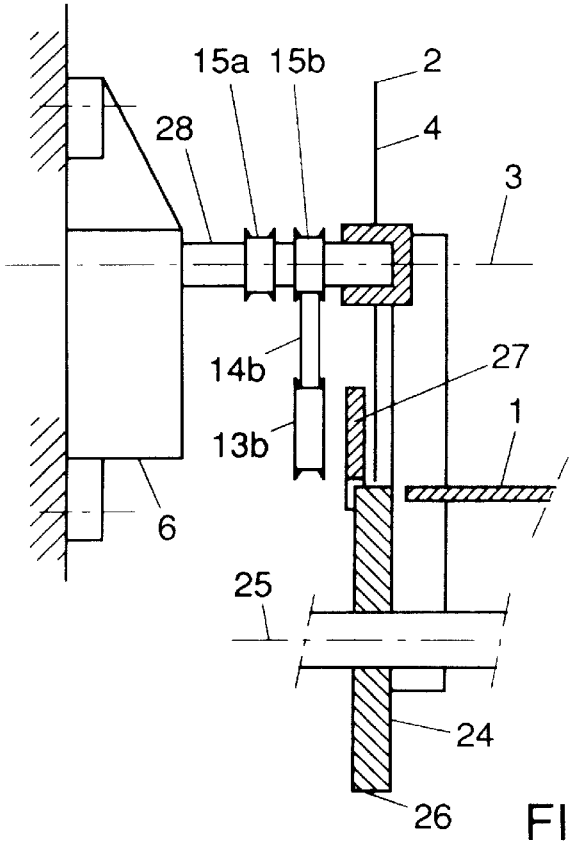
FIG. 4 is a sectional elevation taken on the line IV—IV in FIG. 3.

The apparatus shown in FIGS. 3 and 4 represents the most preferential embodiment of the invention.

In this exemplary embodiment, a supporting roller 24 is arranged opposite the cutting disc 4. The supporting roller 24 is freely rotatable about an axis 25, which is directed parallel to the axis of rotation 3 of the cutting disc 4. The supporting roller 24 has a form-retaining outer circumference 26, which can resist the pressure exerted in operation by the cutting edge 2 on an envelope between the cutting edge 2 and the supporting roller 24 without yielding to an extent where not at least one wall of the envelope is cut through completely. In operation the supporting roller 24 is carried along by envelopes passing over it.

Because the form-retaining supporting roller 24 is arranged opposite the cutting edge 2, a large cutting pressure can be exerted on the envelopes to be opened, so that a reliable cutting action is obtained. The distance between the cutting edge 2 and the outer circumference 26 of the supporting roller 24 is preferably set in such a manner that in a thin envelope (for instance an airmail envelope) still precisely one wall is cut open. In the processing of envelopes made from thicker material, the wall remote from the cutting edge 2 is then incised to some extent but not cut open, so that still no material is detached from the envelope and hence no loose detached material is produced which would require separate discharge.

Each time an envelope has been transported in the direction of transport so far that the upstream transport rollers 9 and 11 no longer engage the envelope, the envelope in question is less stably guided in lateral direction. Because the cutting edge 2 and the transport rollers 10 and 12 drive the envelope in the direction of transport 18 on one side in particular, the envelope tends to rotate in such a manner that the incision deviates from the edge along which it is being provided. This increases the risk of parts of the contents of the envelope being incised. In order to prevent this undesired side effect, a side guide 27 is arranged at a slight distance (preferably 0.6–1.0 mm) next to the cutting edge 2. This prevents a trailing part of the envelope from swerving laterally towards the cutting edge 2 and hence ensures that the incision formed by the cutting edge 2 is not provided beyond said slight distance from the edge of the envelope. This minimizes the risk that parts of the contents are incised along with one of the envelope walls.

For transporting the envelopes, two pairs of transport rollers 9, 11 and 10, 12 are arranged, between which the envelope to be opened is clamped and transported in the direction indicated with an arrow 18.

The cutting disc 4 is mounted directly on an output shaft 28 of the motor 6, as are two toothed rope pulleys 15*a*, 15*b* over which pass toothed drive belts 14*a*, 14*b*, respectively. These toothed drive belts 14*a*, 14*b* also pass over toothed rope pulleys 13*a*, 13*b*, each non-rotatably connected to, in a position coaxial with, one of the transport rollers 9 and 10, respectively. The transmission between the pulleys 13*a*, 13*b*, 15*a*, 15*b*, is chosen such that the circumferential speed of the cutting disc 4 is about six times as high as the circumferential speed of the transport rollers 9, 10, i.e. also six times as high as the speed of transport of the envelopes to be opened.

The apparatus and the method according to the invention can be used as stand-alone opener arranged exclusively for making single incisions or as a burster in an apparatus for unpacking postal items. Such an apparatus is described in U.S. Pat. No. 5,175,979.

Within the framework of the invention, many deviations from the proposed embodiment are possible. For instance, the cutting disc may be coupled, for instance, to a different motor than are the means for transporting the envelopes. The envelopes can be pressed against the cutting edge by flexible fingers, or through a reduced pressure created behind the supporting surface of the transport track. The circular supporting surface 21 directly adjacent to the cutting edge as shown in FIGS. 1 and 2 may be driven in order to function as a transport roller and/or move at a different speed of revolution than does the cutting edge.

We claim:

1. A method for opening a postal envelope having two adjacent, flat walls enclosing at least one document, comprising the steps of:

displacing the postal envelope in a direction of transport at a predetermined speed of transport so that a lengthwise edge of the envelope passes along a circular cutting edge of a cutting disk, said cutting edge being smooth in a circumferential direction of the cutting disk;

allowing the envelope to contact a supporting surface adjacent to and coaxial with the cutting edge to control a depth of penetration of the cutting blade into the envelope; and rotating the cutting disk in a plane parallel to said direction of transport at a circumferential speed different from the speed of transport of the envelope, so that parts of the cutting edge in contact with the envelope move relative to the envelope to form an incision in said one wall along said lengthwise edge while substantially avoiding forming an incision in an adjacent wall of the envelope.

2. A method according to claim 1, wherein the cutting edge, at the location where the incision is made, moves relative to the envelope in the direction of transport of the envelope.

3. A method according to claim 1, wherein a circumferential speed of the cutting edge is at least six times as high as the speed of transport of the envelope.

4. A method according to claim 1, wherein the cutting edge, at the location where the incision is made, moves relative to the envelope in a direction opposite to the transport direction of the envelope.

5. An apparatus for opening a postal envelope having two adjacent, flat walls enclosing at least one document, comprising:

a transport track for transporting the postal envelope at a predetermined speed of transport in a direction of transport;

a cutting disk having a circular cutting edge smooth in a circumferential direction of the disk, said cutting disk being rotatable about an axis of rotation directed transversely to the direction of transport of the transport track, the disk being mounted relative to the transport track so that a part of said cutting edge is directed substantially parallel to the direction of transport of the transport track and projects into the transport rack to contact one wall of the envelope along one lengthwise edge, and drive means coupled to said cutting disk for rotating the cutting edge at a circumferential speed different from the transport speed of said transport track, and so that the part of the cutting edge projecting into the transport track moves relative to the envelope which is travelling at the transport speed of the transport track, wherein, the cutting edge forms a continuous lengthwise incision in said one wall of the envelope along an entire length of the edge while substantially avoiding cutting an adjacent wall of the envelope.

6. An apparatus according to claim 5, comprising means for controlling the speed of transport so that the envelope is transported in the same direction as a direction in which the part of the cutting edge that projects into the transport track moves and at a speed lower than the circumferential speed of the cutting edge.

7. An apparatus according to claim 5, comprising means for controlling the speed of transport so that the speed of transport of the envelope is not greater than one-sixth of the circumferential speed of the cutting edge.

8. An apparatus according to claim 5, comprising means for controlling the speed of transport so that the envelope is transported in a direction opposite to the direction of movement of the part of the cutting edge projecting into the transport track.

9. An apparatus according to claim 5, comprising a supporting surface extending directly adjacent to and coaxially with the cutting edge, the cutting edge projecting radially beyond the supporting surface a predetermined distance corresponding to a cutting depth, wherein the supporting surface contacts said one wall to limit a depth at which the cutting disk penetrates.

10. An apparatus according to claim 9, wherein the supporting surface is coupled to the cutting edge for rotation with the cutting edge.

11. An apparatus according to claim 5, further comprising a supporting roller comprising a circumferential surface positioned opposite to the cutting edge with a small radial distance therebetween to control a cutting pressure and cutting depth of the cutting edge for cutting said one wall of the postal envelope while substantially avoiding the adjacent wall.

12. An apparatus according to claim 5, further comprising a side guide extending an axial distance along the portion of the cutting edge extending in the transport track.

* * * * *